US011382434B2

(12) United States Patent
Choi

(10) Patent No.: US 11,382,434 B2
(45) Date of Patent: Jul. 12, 2022

(54) SUPPORT ASSEMBLY AND FOLDABLE BED FRAME HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 127 days.

(21) Appl. No.: 16/910,647

(22) Filed: Jun. 24, 2020

(65) Prior Publication Data

US 2020/0405067 A1 Dec. 31, 2020

(30) Foreign Application Priority Data

Jun. 28, 2019 (CN) ..... 201921000636.0

(51) Int. Cl.
*A47C 19/12* (2006.01)
*A47C 19/02* (2006.01)

(52) U.S. Cl.
CPC ..... *A47C 19/122* (2013.01); *A47C 19/024* (2013.01); *A47C 19/025* (2013.01)

(58) Field of Classification Search
CPC ... A47C 19/122; A47C 19/024; A47C 19/025; A47C 19/124; A47C 19/126; A47C 19/12; A47C 19/02; A47C 19/128; A47C 17/82; A61G 7/002; F16B 12/54; F16B 12/56
See application file for complete search history.

(56) References Cited

U.S. PATENT DOCUMENTS 807,909 A 12/1905 Braznell
1,360,983 A 11/1920 Burton
1,474,200 A * 11/1923 McKellar ..... A47C 19/122 5/152
2,513,168 A * 6/1950 Gottlieb ..... A47C 19/122 5/111
2,651,787 A 9/1953 Piliero
2,701,603 A 2/1955 Coopersmith
4,048,683 A 9/1977 Chen
5,257,428 A 11/1993 Carroll
9,456,698 B2 * 10/2016 Oh ..... A47C 19/005
D906,003 S * 12/2020 Yang ..... D6/392
2016/0316921 A1 * 11/2016 Choi ..... A47C 19/025

FOREIGN PATENT DOCUMENTS

EP 1166685 A2 * 1/2002 ..... A47C 19/122

* cited by examiner

*Primary Examiner* — Peter M. Cuomo
*Assistant Examiner* — Alison N Labarge
(74) *Attorney, Agent, or Firm* — Morgan, Lewis & Bockius LLP

(57) ABSTRACT

Disclosed are support assemblies and foldable bed frames. A foldable bed frame includes a support assembly, first and second frame units, first and second holders. The first frame unit includes a first frame section pivotally connected with the support assembly and a first leg assembly pivotally connected with the first frame section. The second frame unit includes a second frame section pivotally connected with the support assembly and a second leg assembly pivotally connected with the second frame section. The first and second holders are fixedly coupled with the support assembly, and abut the first and second frame sections when the foldable bed frame is unfolded. When folded, the first and second frame sections are disposed substantially parallel to each other with the first and second leg assemblies disposed at exterior sides of the first and second frame sections.

20 Claims, 9 Drawing Sheets

SUPPORT ASSEMBLY AND FOLDABLE BED FRAME HAVING SAME

CROSS-REFERENCE TO RELATED APPLICATIONS

The present application claims priority to Chinese Utility Model Application CN 201921000636.0 filed Jun. 28, 2019. The disclosure of the application is incorporated herein for all purposes by reference.

FIELD OF THE INVENTION

The present invention generally relates to support assemblies and foldable bed frames. More particularly, the present invention relates to support assemblies and foldable bed frames with generally cubic block or box-like shapes when folded.

BACKGROUND

Nowadays, foldable beds have become increasingly popular. They are widely used in outdoors. They are also used as temporary beds in hospitals when there is a shortage of beds and in fields when natural disasters such as earthquakes occur.

A foldable bed generally includes a foldable bed frame, support legs, and a mattress placed on the foldable bed frame. However, most of current foldable bed frames are inconvenient to use and transport.

Given the current state of the art, there remains a need for support assemblies, and foldable bed frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides support assemblies and foldable bed frames that are convenient to use and transport.

In various exemplary embodiments, the present invention provides a foldable bed frame including a support assembly, a first frame unit, a second frame unit, a first holder and a second holder. The first frame unit is disposed at a first side of the support assembly when the foldable bed frame is unfolded. The first frame includes a first leg assembly, and a first frame section having a proximal side pivotally connected with the support assembly and a distal side pivotally connected with the first leg assembly. The second frame unit is disposed at a second side of the support assembly when the foldable bed frame is unfolded. The second frame includes a second leg assembly, and a second frame section having a proximal side pivotally connected with the support assembly and a distal side pivotally connected with the second leg assembly. The first holder is fixedly coupled with the support assembly to abut the proximal side of the first frame section when the foldable bed frame is unfolded, thereby assisting in holding the first frame section in position when the foldable bed frame is unfolded. The second holder is fixedly coupled with the support assembly to abut the proximal side of the second frame section when the foldable bed frame is unfolded, thereby assisting in holding the second frame section in position when the foldable bed frame is unfolded. When folded, the first and second frame sections are disposed substantially parallel to each other with the first leg assembly disposed at an exterior side of the first frame section and the second leg assembly disposed at an exterior side of the second frame section.

In some exemplary embodiments, the first or second frame unit further includes one or more link bars, each having a first end portion pivotally connected with the support assembly and a second end portion pivotally connected with the first or second leg assembly.

In an exemplary embodiment, each of the one or more link bars is staggered with a peripheral edge of the first or second frame section.

In some exemplary embodiments, the first or second frame unit further includes one or more elastic members, each disposed at the first or second frame section to abut a leg of the first or second leg assembly when the foldable bed frame is folded.

In some exemplary embodiments, the support assembly further includes a plurality of rollers at a lower part of the support assembly.

In some exemplary embodiments, the first and second frame units are symmetric with respect to each other.

In some exemplary embodiments, the first or second frame unit further includes a U-shaped bar coupled with the first or second frame section at the distal side thereof and disposed uprightly in the unfolded state. The U-shaped bar serves as a handle to facilitate easy folding and unfolding of the foldable bed frame, or as a spacer to prevent the first and second frame sections from rotating beyond its folded state.

In some exemplary embodiments, the first frame unit further includes a first connecting member and the second frame unit further includes a second connecting member. The first and second connecting members are coupled with each other when the foldable bed frame is folded, thereby preventing accidental unfolding of the foldable bed frame.

In an exemplary embodiment, the first connecting member is disposed at the distal side of the first frame section and the second connection member is disposed at the distal side of the second frame section.

In some exemplary embodiments, the support assembly includes a left scaffold, a right scaffold, and one or more lateral bars disposed between the left and right scaffolds. Each lateral bar in the more or more lateral bars has one end portion fixedly connected with the left scaffold and the other end portion fixedly connected with the right scaffold. A respective frame section in the first and second frame sections includes a left frame bar pivotally connected with the left scaffold and a right frame bar pivotally connected with the right scaffold of the support assembly.

In an exemplary embodiment, a corresponding holder in the first and second holders includes a left piece and a right piece. The left piece is fixedly coupled with an upper bar of the left scaffold of the support assembly and abuts an upper surface of the left frame bar of the respective frame section when the foldable bed frame is unfolded. The right piece is fixedly coupled with an upper bar of the right scaffold of the support assembly and abuts an upper surface of the right frame bar of the respective frame section when the foldable bed frame is unfolded.

In another exemplary embodiment, a corresponding holder in the first and second holders includes a left piece and a right piece. The left piece is fixedly coupled with a vertical bar of the left scaffold of the support assembly and abuts a lower surface of the left frame bar of the respective frame section when the foldable bed frame is unfolded. The right piece is fixedly coupled with a vertical bar of the right scaffold of the support assembly and abuts a lower surface of the right frame bar of the respective frame section when the foldable bed frame is unfolded.

In still another exemplary embodiment, a corresponding holder in the first and second holders includes a holding lateral bar. The holding lateral bar has a left end portion fixedly connected with the left scaffold to abut the left frame bar of the respective frame section when the foldable bed frame is unfolded and a right end portion fixedly connected with the right scaffold to abut the right frame bar of the respective frame section when the foldable bed frame is unfolded.

In some exemplary embodiments, a corresponding leg assembly in the first and second leg assemblies includes a left leg and a right leg. The first or second frame unit further includes one or more link bars, each having one end portion pivotally connected with a lateral bar in the one or more lateral bars of the support assembly and the other end portion pivotally connected with the left or right leg of the corresponding leg assembly.

In an exemplary embodiment, each of the one or more link bars is staggered with the left and right frame bars of the respective frame section.

In some exemplary embodiments, the first or second frame unit further includes one or more elastic members, each disposed at the respective frame section to abut the left or right leg of the respective leg assembly when the foldable bed frame is folded.

In some exemplary embodiments, the support assembly further includes a plurality of vertical supports and a plurality of rollers. Each vertical support in the plurality of vertical supports has an upper end portion detachably connected with a lateral bar in the one or more lateral bars of the support assembly. Each roller in the plurality of rollers is coupled with a lower end portion of a vertical support in the plurality of vertical supports.

In some exemplary embodiments, the first or second frame unit further includes a U-shaped bar coupled with the first or second frame section at the distal side thereof and disposed uprightly in the unfolded state. The U-shaped bar serves as a handle to facilitate easy folding and unfolding of the foldable bed frame, or as a spacer to prevent the first and second frame sections from rotating beyond its folded state.

In some exemplary embodiments, the first frame unit further includes a first connecting member disposed at the distal side of the first frame section and the second frame unit further includes a second connecting member disposed at the distal side of the second frame section. The first and second connecting members are coupled with each other when the foldable bed frame is folded, thereby preventing accidental unfolding of the foldable bed frame.

In some exemplary embodiments, the first or second scaffold of the support assembly is a substantially rectangular structure formed by a first side vertical bar, a second side vertical bar, an upper bar and a lower bar.

The support assemblies and foldable bed frames of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of exemplary embodiments of the invention.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of support assemblies and foldable bed frames. The bed frames are of various sizes including but not limited to twin, full, queen and king sizes, and of various shapes including but not limited to rectangles and squares. Also, the bed frames can be made of various materials including but not limited to metals such as steel, plastics and woods.

Figure 1:
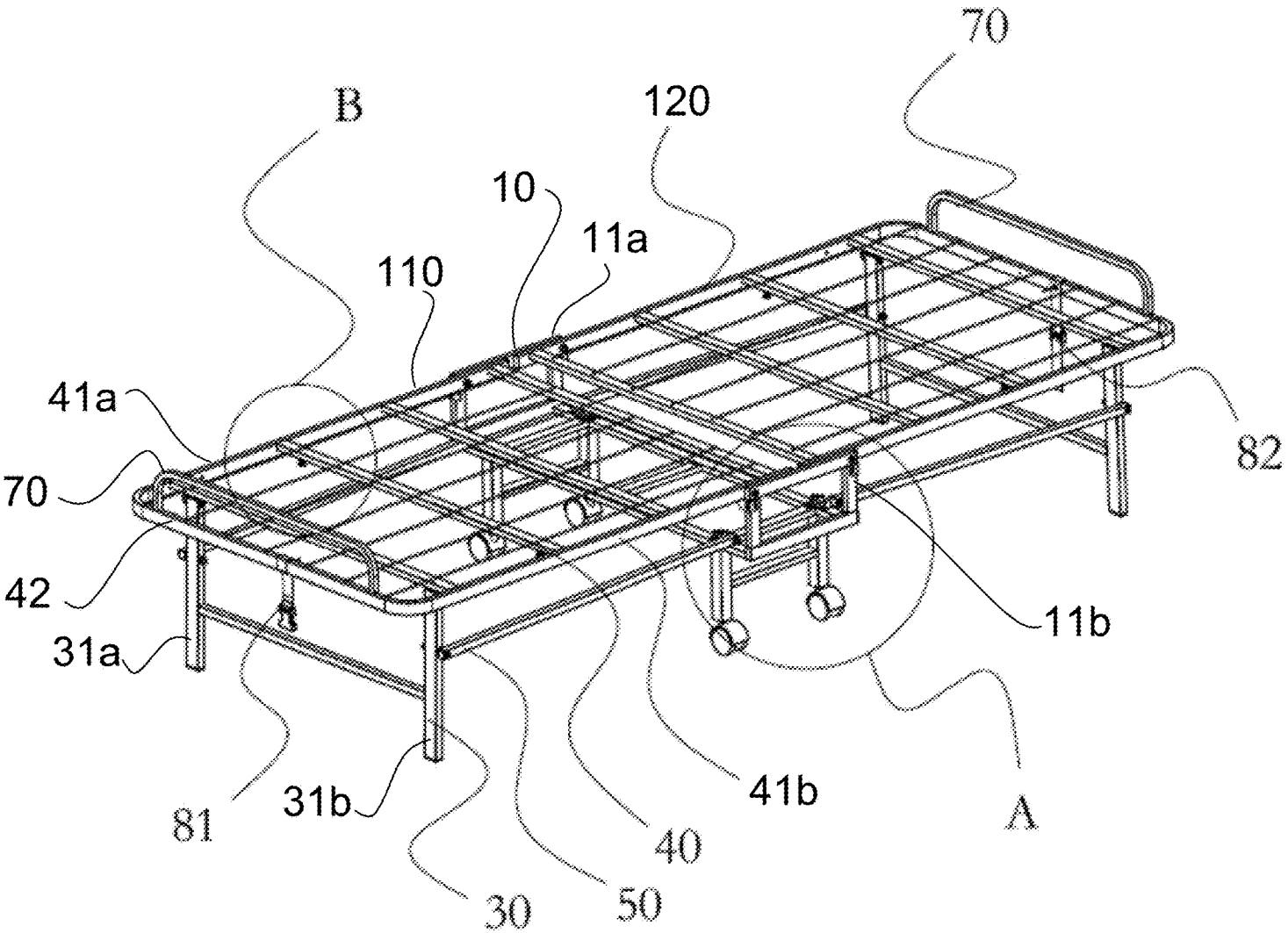
FIG. 1 is a schematic perspective view illustrating a foldable bed frame in an unfolded state in accordance with some exemplary embodiments of the present invention.

Generally, a bed frame of the present invention includes a plurality of frame units pivotally connected with each other by one or more support assemblies. As an example, FIG. 1 illustrates first frame unit 110 and second frame unit 120 connected with each other at their proximal sides by support assembly 10. The frame units can be but do not necessarily have to be identical or symmetric with respect to each other. By way of example, FIG. 1 illustrates symmetric first and second frame units.

As used herein, the sides at which first and second frame units are connected to each other are referred to as their proximal sides, and the sides opposite the proximal sides are referred to as their distal sides. For instance, in FIG. 1, the proximal sides of first and second frame units are in the middle of the foldable bed frame. The distal sides correspond to head and foot sections of the bed frame. The other two sides are referred to as left and right sides. It should be noted that the term "middle" as used herein does not necessarily mean the center of the bed frame, and the term "side" does not necessarily mean an outmost edge of the bed frame. It should also be noted that the term "end" of a part (e.g., a bar, a link) as used herein refers to a tip and/or a portion adjacent the tip of the part.

In various exemplary embodiments, each of the first and second frame units includes a leg assembly and a frame section that has a proximal side pivotally connected with the support assembly and a distal side pivotally connected with the leg assembly. For instance, by way of example, FIG. 1 illustrates first frame unit 110 includes a first leg assembly such as leg assembly 30 and a first frame section such as frame section 40. Frame section 40 has proximal side pivotally connected with support assembly 10 and a distal side pivotally connected with leg assembly 30. Similarly, second frame unit 120 includes a second leg assembly and a second frame section. The second frame section has a proximal side pivotally connected with the support assembly and a distal side pivotally connected with the leg assembly. The first and second frame sections can be configured the same as or differently from each other.

With such pivotal connections, the first frame section of the first frame unit and the second frame section of the second frame unit can be rotated toward each other to fold the bed frame. In the meantime, the first leg assembly can be rotated toward the first frame section and the second leg assembly can be rotated toward the second frame section. When folded, the first and second frame sections are disposed substantially parallel to each other with the first leg assembly disposed at an exterior side of the first frame section and the second leg assembly disposed at an exterior side of the second frame section.

In some exemplary embodiments, each of the first and second frame sections includes a peripheral edge. For instance, as an example, FIG. 1 illustrates first frame section 40 includes a left peripheral edge such as left frame bar 41*a* at the left side of the first frame section and a right peripheral edge such as right frame bar 41*b* at the right side of the first frame section. Similarly, the second frame section (the frame section of second frame unit 120) includes a left peripheral edge at the left side of the second frame section and a right peripheral edge at the right side of the second frame section. In some exemplary embodiments, the left and right frame bars of the first or second frame section are connected to each other at their dismal ends by a distal end frame bar, or integrally formed with the distal end frame bar. For instance, the dismal ends of left frame bar 41*a* and right frame bar 41*b* are connected or integrally formed with distal end frame bar 42. In many cases, left frame bar 41*a*, distal end frame bar 42, and right frame bar 41*b* collectively form a U-shaped peripheral frame, which can be made, for instance, by bending a bar or the like. Similarly, in some exemplary embodiments, the dismal ends of the left and right frame bars of the second frame section are connected or integrally formed with a distal end frame bar, collectively forming a U-shaped peripheral frame.

In some exemplary embodiments, the first leg assembly is coupled with the first frame section at the distal side of the first frame section, and the second leg assembly is coupled with the second frame section at the distal side of the second frame section. In some exemplary embodiments, each of the first and second leg assemblies includes a left leg and a right leg. For instance, as an example, FIG. 1 illustrates first leg assembly 30 including left leg 31*a* and right leg 31*b*. The left leg of the first leg assembly has an upper end pivotally connected with the first frame section at a left distal side of the first frame section. The right leg of the first leg assembly has an upper end pivotally connected with the first frame section at a right distal side of the first frame section. The left leg of the second leg assembly has an upper end pivotally connected with the second frame section at a left distal side of the second frame section. The right leg of the second leg assembly has an upper end pivotally connected with the second frame section at a right distal side of the second frame section.

Figure 2:
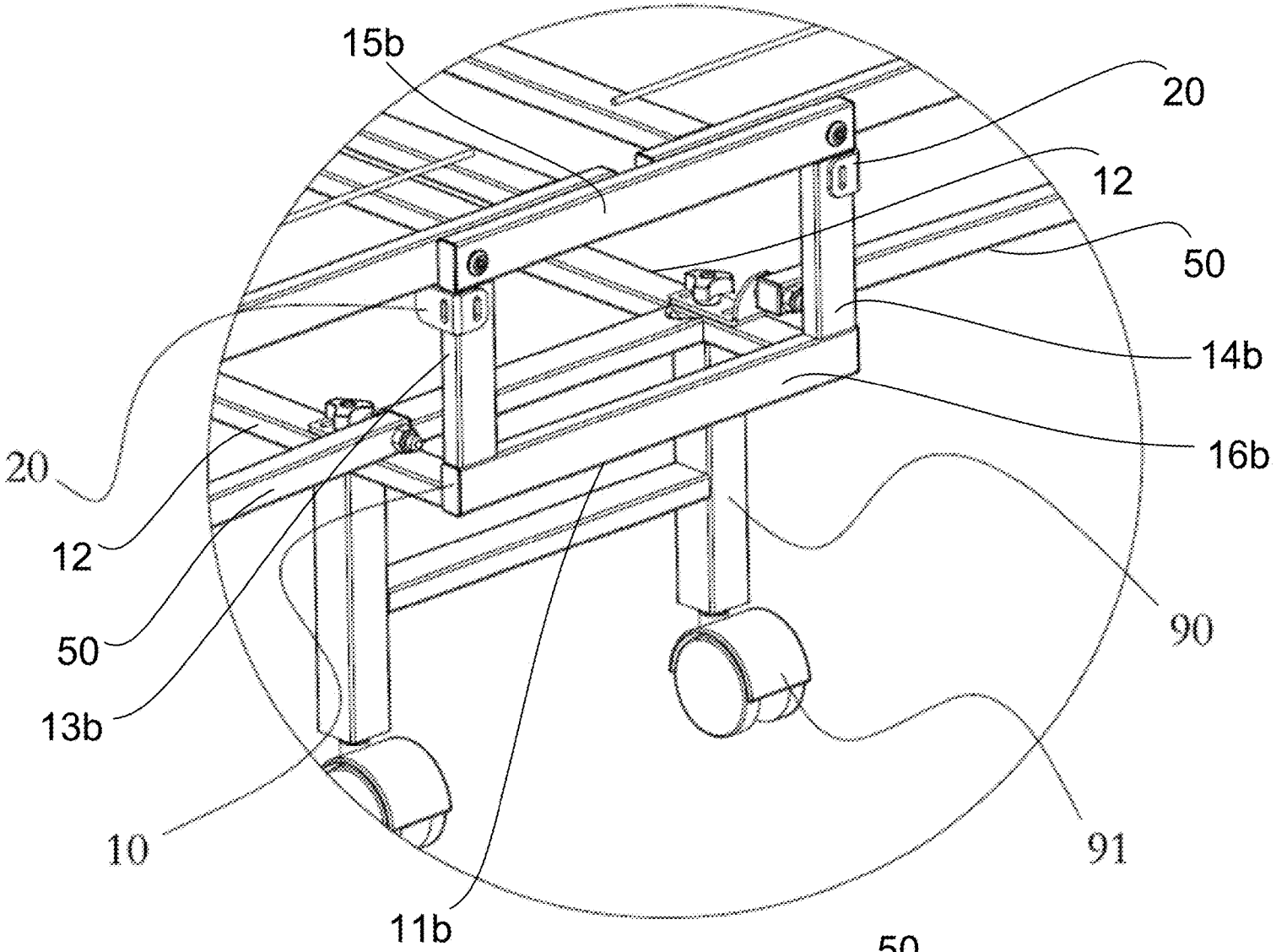
FIG. 2 is an enlarged view taken along circle A of FIG. 1.

Referring to FIGS. 1 and 2, in some exemplary embodiments, the support assembly includes a left scaffold such as left scaffold 11*a*, a right scaffold such as right scaffold 11*b*, and one or more lateral bars such as lateral bar 12 disposed between the left and right scaffolds. In an exemplary embodiment, the support assembly includes at least two lateral bars, one disposed at the first side of the support assembly (e.g., the side toward first frame unit 110) and one disposed at the second side of the support assembly (e.g., the side toward second frame unit 120). Lateral bar 12 has one end portion fixedly connected with the left scaffold and the other end portion fixedly connected with the right scaffold. In embodiments where the first or second frame section includes a left frame bar (e.g., frame bar 41*a*) and a right frame bar (e.g., frame bar 41*b*), the left frame bar is pivotally connected with the left scaffold and the right frame bar pivotally connected with the right scaffold of the support assembly.

In some exemplary embodiments, the first or second scaffold of the support assembly is a substantially rectangular structure formed by a first side vertical bar, a second side vertical bar, an upper bar and a lower bar. For instance, FIG. 2 illustrates second scaffold 11*b* formed by first side vertical bar 13*b*, second side vertical bar 14*b*, upper bar 15*b* and lower bar 16*b*.

In some exemplary embodiments, the bed frame of the present disclosure further includes a plurality of holders fixedly coupled with the support assembly and configured to assist in holding the bed frame in position when the bed frame is unfolded. For instance, in some exemplary embodiments, the bed frame of the present disclosure includes a first holder such as holder 20 fixedly coupled with the support assembly to abut the proximal side of the first frame section when the foldable bed frame is unfolded, thereby assisting in holding the first frame section in position when the foldable bed frame is unfolded. The bed frame of the present disclosure also includes a second holder such as holder 20 fixedly coupled with the support assembly to abut the proximal side of the second frame section when the foldable bed frame is unfolded, thereby assisting in holding the second frame section in position when the foldable bed frame is unfolded.

Figure 6:
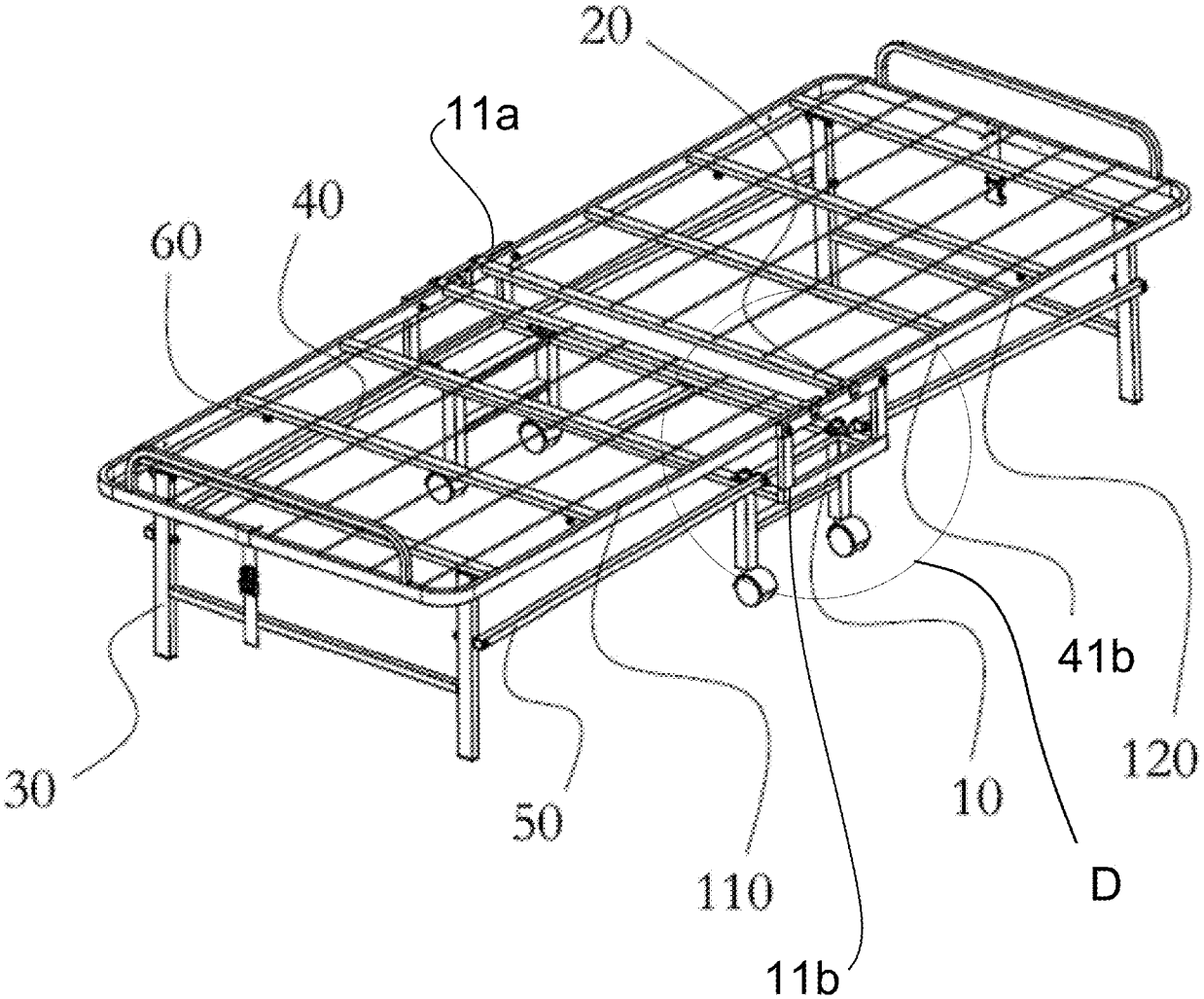
FIG. 6 is a schematic perspective view illustrating a foldable bed frame in an unfolded state in accordance with some exemplary embodiments of the present invention.
Figure 7:
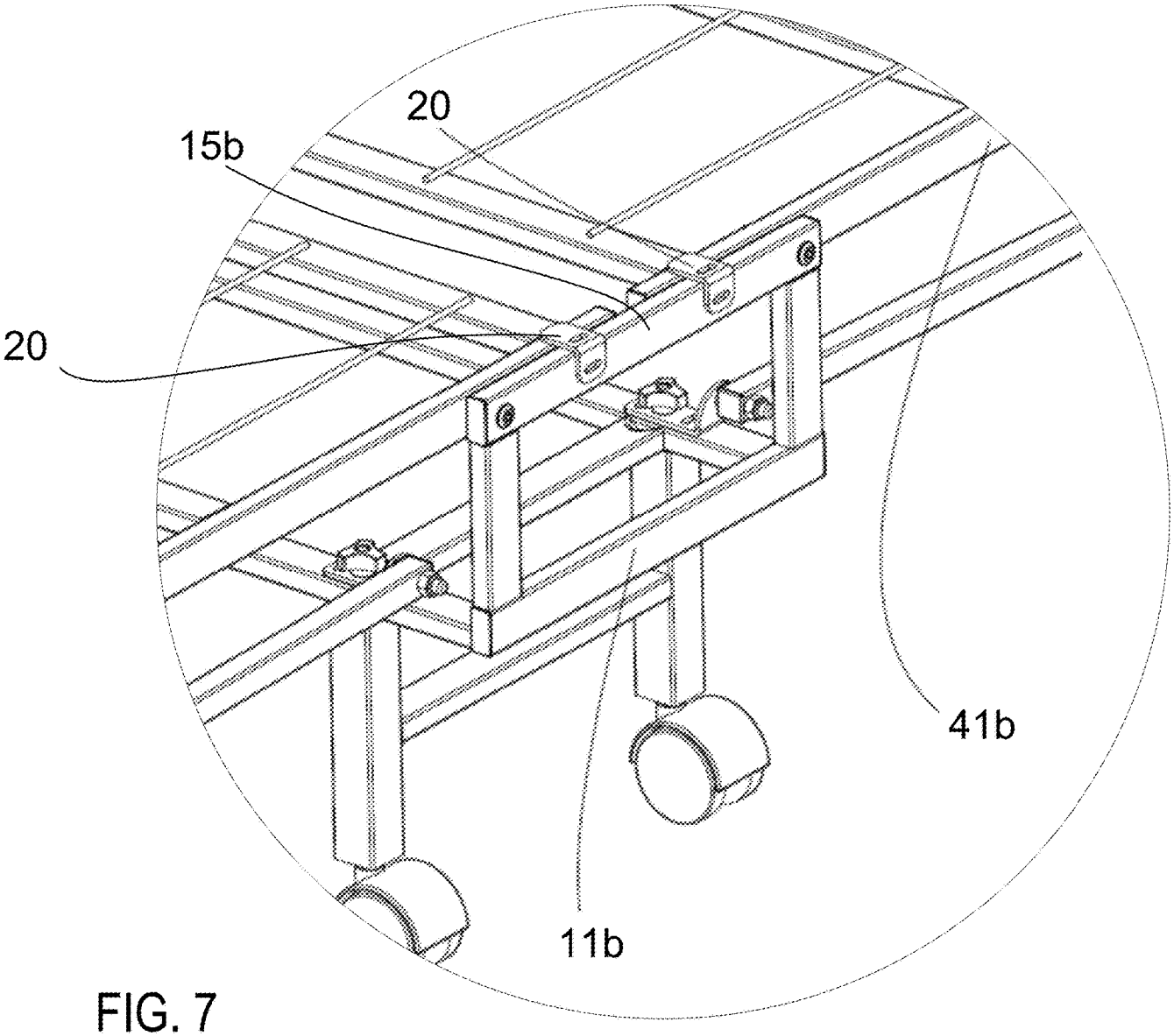
FIG. 7 is an enlarged view taken along circle D of FIG. 6.
Figure 8:
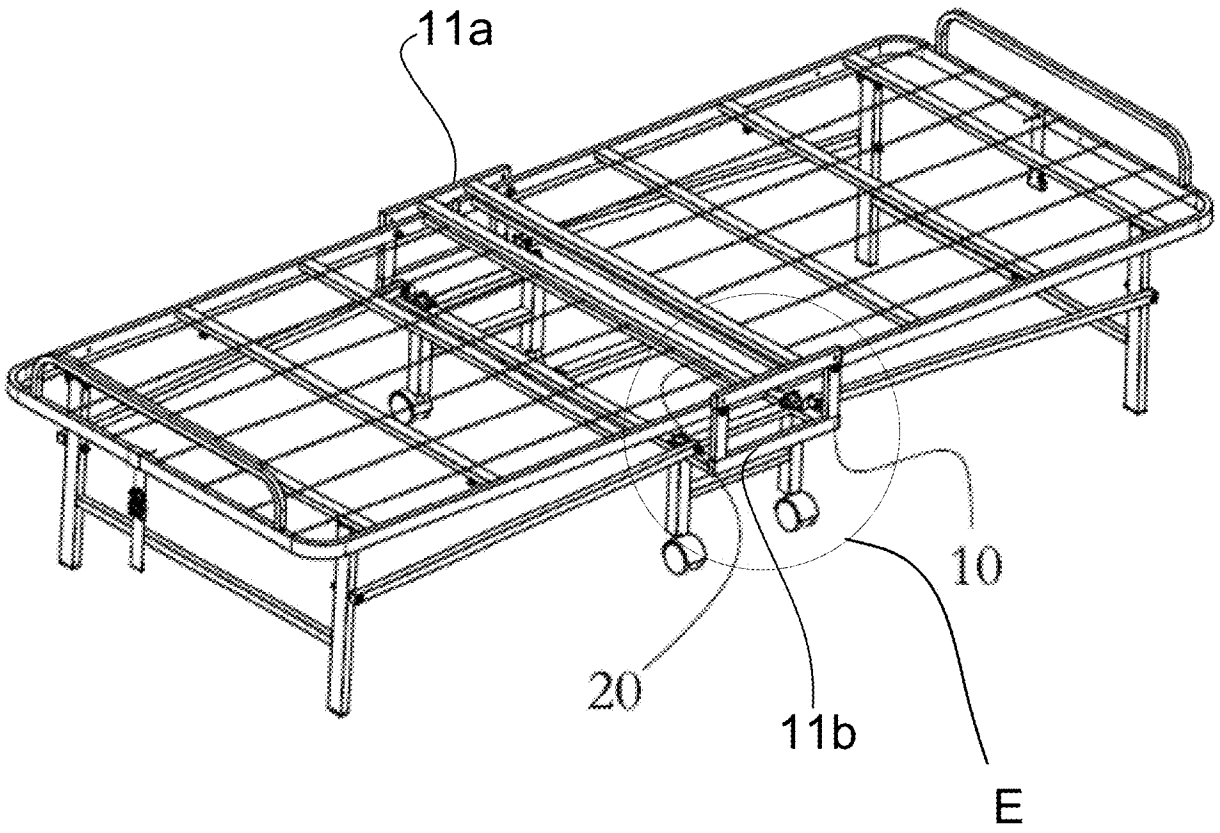
FIG. 8 is a schematic perspective view illustrating a foldable bed frame in an unfolded state in accordance with some exemplary embodiments of the present invention.
Figure 9:
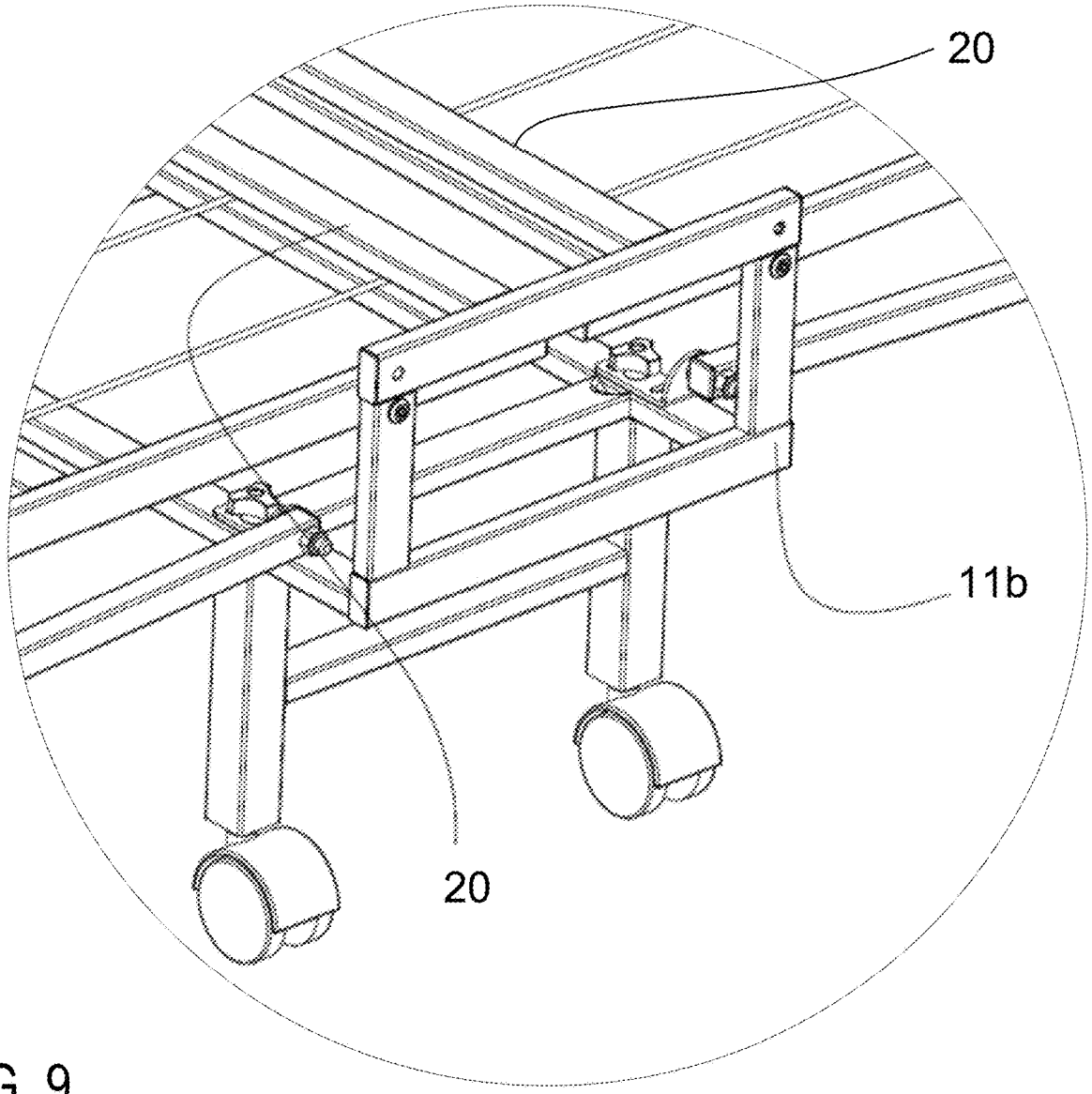
FIG. 9 is an enlarged view taken along circle E of FIG. 8.

While the first and second holders are illustrated substantially the same in the illustrated embodiments, it should be noted that these are non-limiting examples and that the first and second holders can be configured the same as or differently from each other. Moreover, each holder can be configured in a variety of ways. For instance, as an example, FIGS. 1 and 2 illustrate that holder 20 includes a left piece and a right piece. The left piece is fixedly coupled with a vertical bar of the left scaffold of the support assembly and abuts a lower surface of the left frame bar of the respective frame section when the foldable bed frame is unfolded. The right piece is fixedly coupled with a vertical bar (e.g., vertical bar 13*b* or 14*b*) of the right scaffold of the support assembly and abuts a lower surface of the right frame bar of the respective frame section when the foldable bed frame is unfolded. As another example, FIGS. 6 and 7 illustrate that holder 20 also includes a left piece and a right piece. In this embodiment, the left piece is fixedly coupled with an upper bar of the left scaffold of the support assembly and abuts an upper surface of the left frame bar of the respective frame section when the foldable bed frame is unfolded. The right piece is fixedly coupled with an upper bar (e.g., upper bar 15*b*) of the right scaffold of the support assembly and abuts an upper surface of the right frame bar of the respective frame section when the foldable bed frame is unfolded. As a further example, FIGS. 8 and 9 illustrate holder 20 being a holding lateral bar that has a left end portion fixedly connected with the left scaffold and a right end portion fixedly connected with the right scaffold. When the foldable bed frame is unfolded, the left end portion abuts the left frame bar of the respective frame section and the right end portion abuts the right frame bar of the respective frame section. While in the illustrated embodiments, the holding lateral bar abuts the upper surfaces of the left and right frame bars, it should be noted that the holding lateral bar can be configured to abut the lower surfaces of the left and right frame bars, for instance, by placing the holding lateral bar below the first or section frame section.

Referring to FIGS. 1-2 and 3-4, in some exemplary embodiments, one or each of the first and second frame units further includes one or more link bars, each having a first end portion pivotally connected with the support assembly and a second end portion pivotally connected with the first or second leg assembly. For instance, in the illustrated embodiments, each of the first and second frame units includes two link bars 50. The first end portion of link bar 50 is pivotally connected with the support assembly such as lateral bar 12 of the support assembly, for instance, through a fastener, a bracket or other suitable means. The second end portion of link bar 50 is pivotally connected with a leg (e.g., leg 31*a* or leg 31*b*) of the first or second leg assembly. While the link bars are illustrated substantially the same in the illustrated embodiments, it should be noted that these are non-limiting examples. The link bars of the first and second frame units can be configured the same as or differently from each other, and the link bars of the same frame unit (e.g., the first or second frame unit) can be configured the same as or differently from each other.

Link bar 50 enhances the stability of the foldable bed frame when it is unfolded or in use. Link bar 50 also assists in folding and unfolding of the foldable bed frame. For instance, when folding the bed frame, link bars 50 pull and rotate the first and second leg assemblies towards the first and second frame sections, respectively. When unfolding the bed frame, link bars 50 push and rotate the first and second leg assemblies away from the first and second frame sections, respectively.

In some exemplary embodiments, link bar 50 is staggered with a peripheral edge of the first or second frame section, e.g., not aligned vertically with the peripheral edge of the first or second frame section. For instance, in some exemplary embodiments, corresponding to one or each of the first and second frame units, a link bar is disposed at a left side of the foldable bed frame and staggered with the left frame bar (e.g., frame bar 41*a*) and a link bar is disposed at a right side of the foldable bed frame and staggered with the right frame bar (e.g., frame bar 41*b*). In an exemplary embodiment, the staggering is along the lateral direction of the foldable bed frame, e.g., the link bar retreats inwardly with respect to the peripheral edge (e.g., frame bar 41*a* or 41*b*). As such, when folding and unfolding the bed frame, the link bar would not interfere with the first or second frame section. Moreover, when folded, the link bar assists in putting the first and second leg assemblies in position such that they are substantially parallel to the first and second frame sections and substantially parallel to each other. As such, when folded, the bed frame generally appears to be of a seemingly block or box-like shape, making it easy and convenient for packaging and shipping.

Figure 3:
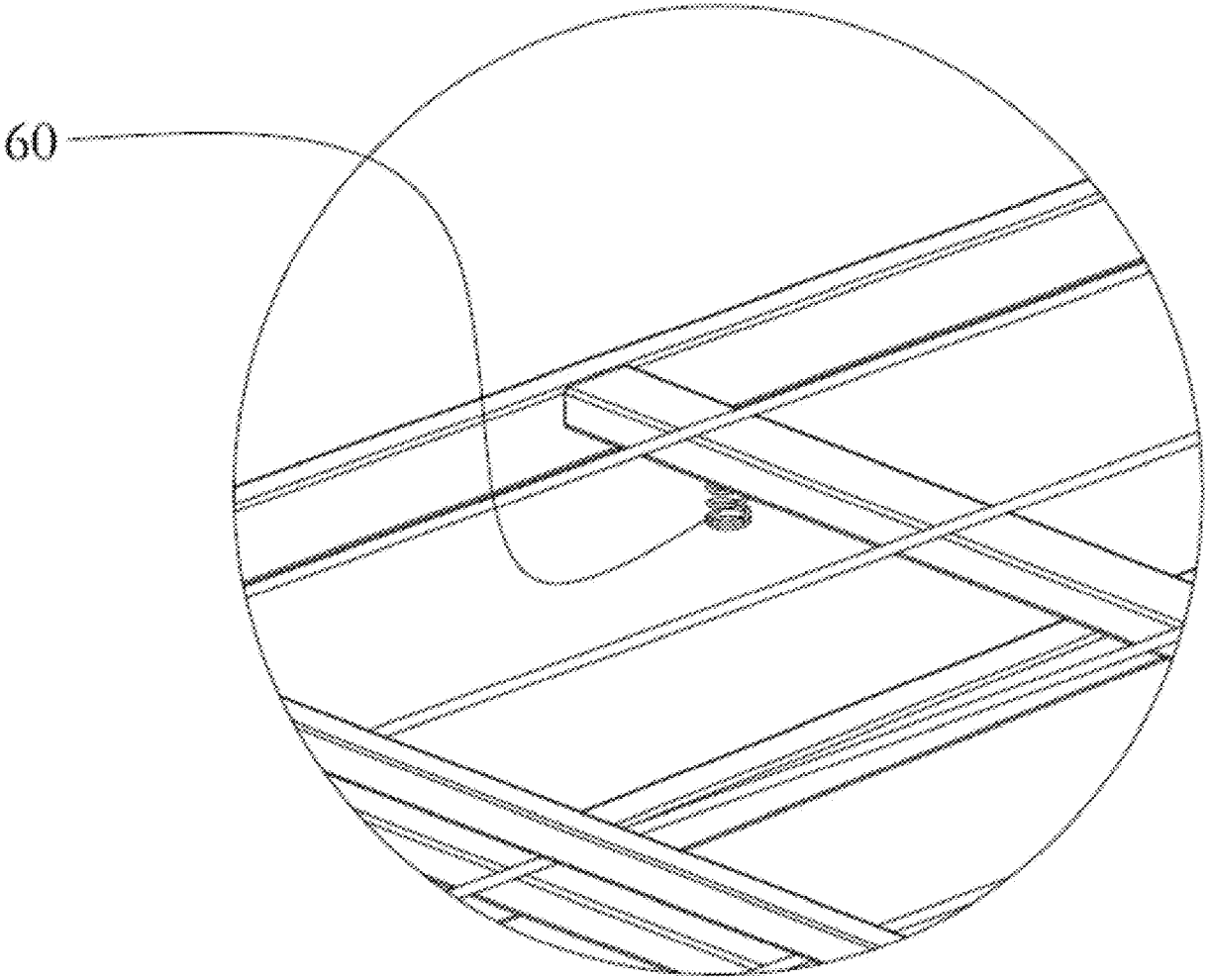
FIG. 3 is an enlarged view taken along circle B of FIG. 1.
Figure 4:
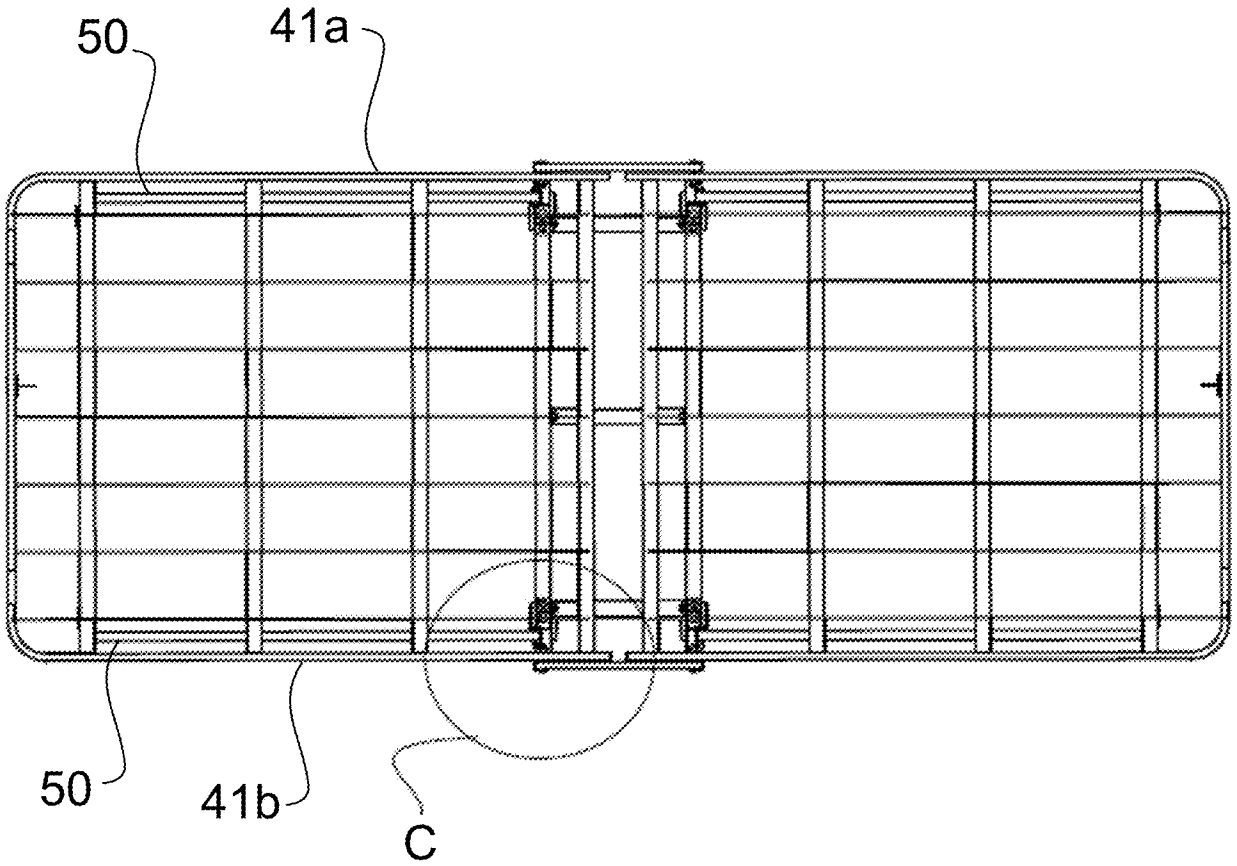
FIG. 4 is a schematic top view illustrating the foldable bed frame of FIG. 1.
Figure 5:
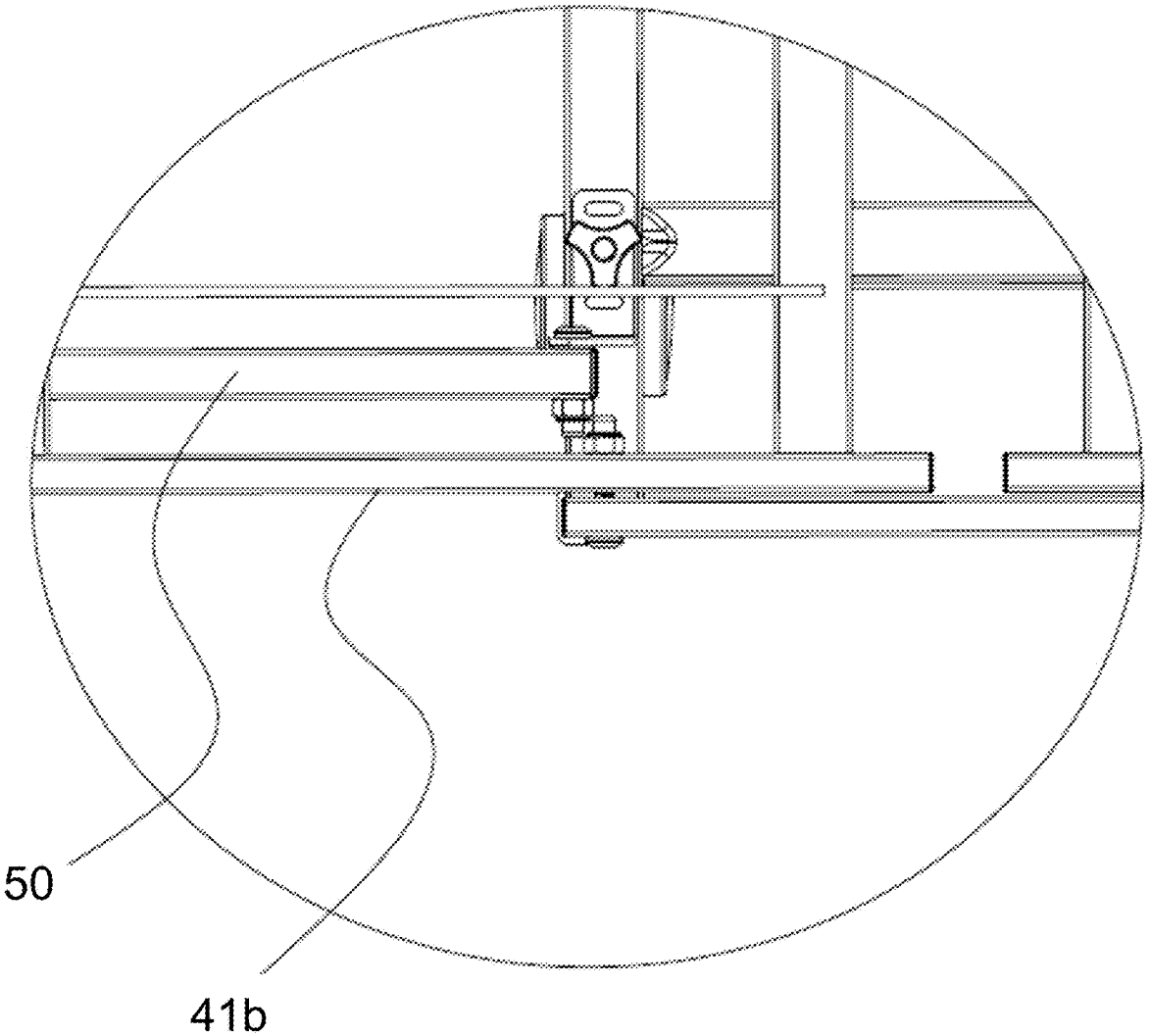
FIG. 5 is an enlarged view taken along circle C of FIG. 4.

Referring to FIGS. 1 and 3, in some exemplary embodiments, one or each of the first and second frame units includes one or more elastic members such as elastic member 60 disposed at the first or second frame section. When the foldable bed frame is folded, elastic member 60 abuts the first or second leg assembly. For instance, in an exemplary embodiment, elastic member 60 abuts a leg (e.g., leg 31*a* or 31*b*) of the first or second leg assembly when the leg assembly is folded onto the corresponding frame section. Elastic member 60 keeps the leg of the first or second leg assembly from getting too close to the first or second frame section, making it easy and convenient for folding and unfolding the bed frame. Moreover, elastic member 60 assists in holding the first and second leg assemblies in position such that they are substantially parallel to the first and second frame sections and substantially parallel to each other. As such, when folded, the bed frame has a seemingly general block or box-like shape and thus is easy and convenient for packaging and shipping.

In some exemplary embodiments, the first or second frame unit includes a U-shaped bar coupled with the distal end frame bar and disposed uprightly in the unfolded state. For instance, FIG. 1 illustrates one U-shaped bar 70 coupled with the distal end frame bar of first frame unit 110 and another U-shaped bar 70 coupled with the distal end frame bar of second frame unit 120. The U-shaped bar can serve as a handle to facilitate easy folding and unfolding of the foldable bed. In an exemplary embodiment, the U-shaped bar also serves as a spacer to prevent the first and second frames from rotating beyond its folded state.

In some exemplary embodiments, the first frame unit further includes a first connecting member such as connecting member 81 and the second frame unit further includes a second connecting member such as connecting member 82. In an exemplary embodiment, the first connecting member is disposed at the distal side of the first frame section and the second connection member is disposed at the distal side of the second frame section. The first and second connecting members are configured to be coupled with each other when the foldable bed frame is folded, thereby preventing accidental unfolding of the foldable bed frame. For instance, in some exemplary embodiments, the first and second connecting members are straps. In an exemplary embodiment, one of the straps is provided with a slot, and the other strap is provided with a latch that mates with the slot. When the bed frame is folded, the straps can be used to hold the folded bed frame and prevent the bed frame from accidental unfolding.

Referring to FIGS. 1 and 2, in some exemplary embodiments, the support assembly includes a plurality of rollers configured to help moving around the foldable bed frame of the present disclosure. For instance, in an exemplary embodiment, support assembly 10 includes a plurality of vertical supports 90 and a plurality of rollers 91. Each vertical support 90 has an upper end portion detachably connected (e.g., by a fastener or the like) with a lateral bar (e.g., lateral bar 12) of the support assembly and a lower end portion connected with a roller. When folded, the rollers are disposed at the bottom of the folded bed frame. As such, it is easy and convenient to move around the foldable bed frame of the present disclosure. In addition, the detachable connection of vertical supports 90 with lateral bar 12 of the support assembly allows vertical supports 90 to be disassembled, for instance, to save space for storage or packaging.

The support assembly and the foldable bed frame can include additional, alternative, or optional elements. For instance, the bed frame can include one or more frame lateral bars, one or more leg lateral bars, and/or one or more oblique supports that connect the first and second leg assemblies with the first and second frame sections.

The foldable bed frame of the present invention is easy to use. For instance, to fold the foldable bed frame, simply rotate the first and/or second frame sections toward each other (e.g., by pulling up the handle). While the first and/or second frame sections rotate toward each other, link bars 50 pull and rotate the first and second leg assemblies towards the first and second frame sections, respectively. When folded, the first and second frame sections are disposed substantially parallel to each other with the first leg assembly disposed at an exterior side of the first frame section and the second leg assembly disposed at an exterior side of the second frame section.

Moreover, the foldable bed frame of the present disclosure requires less storage space. For instance, with the proximal portions of the left and right frame bars of the first and second frames disposed within the support assembly, the length of the foldable bed frame when folded is minimized.

Further, with the elastic members holding the first and second leg assemblies in position and the staggered link bars avoiding interference with the peripheral edge of the first or second frame section, the foldable bed frame of the present disclosure when folded would generally appear to be of a seemingly block or box-like shape. As such, it is easy and convenient to package and ship the foldable bed frame of the present disclosure.

In addition, with the first and second connecting members, accidental unfolding can be prevented. With the rollers, the folded frame can be moved around easily.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "left" or "right", "longitudinal" or "lateral", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first frame unit could be termed a second frame unit, and, similarly, a second frame unit could be termed a first frame unit, without changing the meaning of the description, so long as all occurrences of the "first frame unit" are renamed consistently and all occurrences of the "second frame unit" are renamed consistently.

What is claimed is:

1. A foldable bed frame comprising:

a support assembly;

a first frame unit disposed at a first side of the support assembly when the foldable bed frame is unfolded, the first frame comprising:

a first leg assembly; and a first frame section having a proximal side pivotally connected with the support assembly and a distal side pivotally connected with the first leg assembly;

a second frame unit disposed at a second side of the support assembly when the foldable bed frame is unfolded, the second frame comprising:

a second leg assembly; and a second frame section having a proximal side pivotally connected with the support assembly and a distal side pivotally connected with the second leg assembly;

a first holder fixedly coupled with the support assembly to allow the first frame section to fold and unfold while the first holder maintains fixedly coupled with the support assembly, and to abut the proximal side of the first frame section when the foldable bed frame is unfolded, thereby assisting in holding the first frame section in position when the foldable bed frame is unfolded; and a second holder fixedly coupled with the support assembly to allow the second frame section to fold and unfold while the second holder maintains fixedly coupled with the support assembly, and to abut the proximal side of the second frame section when the foldable bed frame is unfolded, thereby assisting in holding the second frame section in position when the foldable bed frame is unfolded, wherein when folded, the first and second frame sections are disposed substantially parallel to each other with the first leg assembly disposed at an exterior side of the first frame section and the second leg assembly disposed at an exterior side of the second frame section.

2. The foldable bed frame of claim 1, wherein the first or second frame unit further comprises:

one or more link bars, each having a first end portion pivotally connected with the support assembly and a second end portion pivotally connected with the first or second leg assembly.

3. The foldable bed frame of claim 2, wherein each of the one or more link bars is staggered with a peripheral edge of the first or second frame section.

4. The foldable bed frame of claim 1, wherein the first or second frame unit further comprises:

one or more elastic members, each disposed at the first or second frame section to abut a leg of the first or second leg assembly when the foldable bed frame is folded.

5. The foldable bed frame of claim 1, wherein the support assembly further comprises a plurality of rollers at a lower part of the support assembly.

6. The foldable bed frame of claim 1, wherein the first and second frame units are symmetric with respect to each other.

7. The foldable bed frame of claim 1, wherein the first or second frame unit further comprises:

a U-shaped bar coupled with the first or second frame section at the distal side thereof and disposed uprightly in the unfolded state, wherein the U-shaped bar serves as a handle to facilitate easy folding and unfolding of the foldable bed frame, or as a spacer to prevent the first and second frame sections from rotating beyond its folded state.

8. The foldable bed frame of claim 1, wherein the first frame unit further comprises a first connecting member and the second frame unit further comprises a second connecting member, wherein the first and second connecting members are coupled with each other when the foldable bed frame is folded, thereby preventing accidental unfolding of the foldable bed frame.

9. The foldable bed frame of claim 8, wherein the first connecting member is disposed at the distal side of the first frame section and the second connection member is disposed at the distal side of the second frame section.

10. The foldable bed frame of claim 1, wherein:

the support assembly comprises a left scaffold, a right scaffold, and one or more lateral bars disposed between the left and right scaffolds, wherein each lateral bar in the more or more lateral bars has one end portion fixedly connected with the left scaffold and the other end portion fixedly connected with the right scaffold; and a respective frame section in the first and second frame sections comprises a left frame bar pivotally connected with the left scaffold and a right frame bar pivotally connected with the right scaffold of the support assembly.

11. The foldable bed frame of claim 10, wherein a corresponding holder in the first and second holders comprises:

a left piece fixedly coupled with an upper bar of the left scaffold of the support assembly and abuts an upper surface of the left frame bar of the respective frame section when the foldable bed frame is unfolded; and a right piece fixedly coupled with an upper bar of the right scaffold of the support assembly and abuts an upper surface of the right frame bar of the respective frame section when the foldable bed frame is unfolded.

12. The foldable bed frame of claim 10, wherein a corresponding holder in the first and second holders comprises:

a holding lateral bar having a left end portion fixedly connected with the left scaffold to abut the left frame bar of the respective frame section when the foldable bed frame is unfolded and a right end portion fixedly connected with the right scaffold to abut the right frame bar of the respective frame section when the foldable bed frame is unfolded.

13. The foldable bed frame of claim 10, wherein:

a corresponding leg assembly in the first and second leg assemblies comprises a left leg and a right leg; and the first or second frame unit further comprises one or more link bars, each having one end portion pivotally connected with a lateral bar in the one or more lateral bars of the support assembly and the other end portion pivotally connected with the left or right leg of the corresponding leg assembly.

14. The foldable bed frame of claim 13, wherein each of the one or more link bars is staggered with the left and right frame bars of the respective frame section.

15. The foldable bed frame of claim 13, wherein the first or second frame unit further comprises:

one or more elastic members, each disposed at the respective frame section to abut the left or right leg of the respective leg assembly when the foldable bed frame is folded.

16. The foldable bed frame of claim 10, wherein the support assembly further comprises:

a plurality of vertical supports, each having an upper end portion detachably connected with a lateral bar in the one or more lateral bars of the support assembly; and a plurality of rollers, each coupled with a lower end portion of a vertical support in the plurality of vertical supports.

17. The foldable bed frame of claim 10, wherein the first or second frame unit further comprises:

a U-shaped bar coupled with the first or second frame section at the distal side thereof and disposed uprightly in the unfolded state, wherein the U-shaped bar serves as a handle to facilitate easy folding and unfolding of the foldable bed frame, or as a spacer to prevent the first and second frame sections from rotating beyond its folded state.

18. The foldable bed frame of claim 10, wherein the first frame unit further comprises a first connecting member disposed at the distal side of the first frame section and the second frame unit further comprises a second connecting member disposed at the distal side of the second frame section, wherein the first and second connecting members are coupled with each other when the foldable bed frame is folded, thereby preventing accidental unfolding of the foldable bed frame.

19. The foldable bed frame of claim 10, wherein the left or right scaffold of the support assembly is a substantially rectangular structure formed by a first side vertical bar, a second side vertical bar, an upper bar and a lower bar.

20. A foldable bed frame comprising:

a support assembly;

a first frame unit disposed at a first side of the support assembly when the foldable bed frame is unfolded, the first frame comprising:

a first leg assembly; and a first frame section having a proximal side pivotally connected with the support assembly and a distal side pivotally connected with the first leg assembly;

a second frame unit disposed at a second side of the support assembly when the foldable bed frame is unfolded, the second frame comprising:

a second leg assembly; and a second frame section having a proximal side pivotally connected with the support assembly and a distal side pivotally connected with the second leg assembly;

a first holder fixedly coupled with the support assembly to abut the proximal side of the first frame section when the foldable bed frame is unfolded, thereby assisting in holding the first frame section in position when the foldable bed frame is unfolded; and a second holder fixedly coupled with the support assembly to abut the proximal side of the second frame section when the foldable bed frame is unfolded, thereby assisting in holding the second frame section in position when the foldable bed frame is unfolded, wherein when folded, the first and second frame sections are disposed substantially parallel to each other with the first leg assembly disposed at an exterior side of the first frame section and the second leg assembly disposed at an exterior side of the second frame section, wherein:

the support assembly comprises a left scaffold, a right scaffold, and one or more lateral bars disposed between the left and right scaffolds, wherein each lateral bar in the more or more lateral bars has one end portion fixedly connected with the left scaffold and the other end portion fixedly connected with the right scaffold;

a respective frame section in the first and second frame sections comprises a left frame bar pivotally connected with the left scaffold and a right frame bar pivotally connected with the right scaffold of the support assembly; and a corresponding holder in the first and second holders comprises:

a left piece fixedly coupled with a vertical bar of the left scaffold of the support assembly and abuts a lower surface of the left frame bar of the respective frame section when the foldable bed frame is unfolded; and a right piece fixedly coupled with a vertical bar of the right scaffold of the support assembly and abuts a lower surface of the right frame bar of the respective frame section when the foldable bed frame is unfolded.

* * * * *